US006983515B1

(12) United States Patent
Jirsák et al.

(10) Patent No.: US 6,983,515 B1
(45) Date of Patent: Jan. 10, 2006

(54) DEVICE FOR PERPENDICULAR STRATIFICATION OF PLANARY FIBROUS SHAPES

(75) Inventors: Oldřich Jirsák, Liberec (CZ); Jaroslav Hanuš, Liberec (CZ); Václav Kotek, Liberec (CZ); Filip Sanetrník, Liberec (CZ); Radko Krčma, Liberec (CZ)

(73) Assignee: Charles F. Parsons, Fort Myers, FL (US)

( * ) Notice: Subject to any disclaimer, the term of this patent is extended or adjusted under 35 U.S.C. 154(b) by 0 days.

(21) Appl. No.: 09/700,743

(22) PCT Filed: May 25, 1998

(86) PCT No.: PCT/CZ98/00025

§ 371 (c)(1),
(2), (4) Date: Nov. 20, 2000

(87) PCT Pub. No.: WO99/61693

PCT Pub. Date: Dec. 2, 1999

(51) Int. Cl.
*D01G 19/00* (2006.01)

(52) U.S. Cl. ..... 19/115 R

(58) Field of Classification Search ..... 19/225, 19/115 R, 215, 296, 298, 302, 160, 161.1, 19/163; 156/435, 459; 428/93
See application file for complete search history.

(56) References Cited

U.S. PATENT DOCUMENTS 2,638,959 A * 5/1953 Johnson ..... 428/93
2,638,960 A * 5/1953 Reinhardt ..... 156/435
3,010,508 A * 11/1961 Wilson et al. ..... 156/459
5,110,397 A * 5/1992 Fraser ..... 156/435

FOREIGN PATENT DOCUMENTS

| | | |
|---|---|---|
| CZ | 37 619 | 10/1931 |
| CZ | 37 619 P | 10/1931 |
| CZ | 56 029 P | 10/1936 |
| CZ | 56 029 | 10/1936 |
| CZ | 87 556 | 4/1952 |
| CZ | 87 556 P | 4/1952 |
| CZ | 1819-92 | 4/1978 |
| CZ | 1819-92 PV | 4/1978 |
| CZ | 235494 | 11/1986 |
| CZ | 235494 AO | 11/1986 |
| CZ | 269300 AO | 1/1991 |
| CZ | 269300 | 11/1991 |
| CZ | 273997 AO | 5/1992 |
| CZ | 273997 | 5/1992 |

* cited by examiner

*Primary Examiner*—Gary L. Welch
(74) *Attorney, Agent, or Firm*—Burns, Doane, Swecker & Mathis, L.L.P.

(57) ABSTRACT

A device for perpendicular stratification of planary fibrous shapes, above all of fibrous web, comprising two synchronously moving elements, connected with the driving mechanism according to the invention consists in that the reciprocating moving elements are connected with their driving mechanism indirectly by the intermediary of at least one robust shaft rigidly fitted in bearings in a rigid framework of the machine, while one element is connected with the shaft rigidly or over flexible joints, and a second element is coupled by means of flexible joints with the same shaft or with another shaft. The driving mechanism can consist of one driving shaft with two crank assemblies arranged with a phase shift to one another. The flexible joints consist of flat steel springs with a width-to-thickness ratio more than 10.

12 Claims, 1 Drawing Sheet

DEVICE FOR PERPENDICULAR STRATIFICATION OF PLANARY FIBROUS SHAPES

The scope of the patent is a device for production of voluminous shapes by perpendicular stratification of planary fibrous shapes, above all of fibrous web from a carding machine.

DESCRIPTION OF THE PRIOR ART

For the production of webbing from a web as obtained from machines with carding effect substatially three basic principles are known and used, based on parallel, cross or perpendicular web stratification. The method of the fibrous layer preparation and the related fibre orientation in the layer has a deciding importance for the product properties. In the case of voluminous products, which are exposed in their application to a single, repeated or longlasting stress, the best properties are obtained by preparing the fibrous layer by perpendicular stratification of the web. Under most variable conditions such products best retain their functional properties, especially as fillers or thermal insulants.

Several types of equipment working on rotational or vibration principle are known in the production of a fibrous layer composed of fibres laid substantially perpendicularly to the product plane.

Perpendicular laying devices on rotational principle form the web by means of various types of rotating elements such as gear wheels, cylinders with pins or rotating disks with specially shaped indents between which the web is fed. A merit of such systems protected e.g. by CZ AO 273997 is their high performance and a wide range of perpendicularly laid produced webbing. A limitation is their limited possibility of controlling the fibre position at various specific densities of the web, and a heterogenous structure of product surface. A deviation of fibre orientation from a perpendicular orientation to the layer surface makes the compressing resistance of the product decline. Rotating elements of the laying device such as e.g. a system of wires, formed disks or indentations produce a row-like structure, connected with an irregular density of fibre distribution in the product area.

Vibration laying devices work on the principle of shaping the fed web by a forming batten with an eventual upholding of shaped plaits by a thrust batten. The machines working on this principle are known in various arrangements, and are mostly adapted to the requirements on the product properties. So e.g. according to the U.S. Pat. No. 2,638,960 a device consists of a horizontally vibrating cheek which in compressed condition feeds the web or a yarn system onto a base layer and in the back position the thrust batten presses the material in the form of a loop to the base layer with an adhesive.

According to CZ P 37 619 the web fed horizontally is bent by vertically situated battens from upside and from downside. The web fibres are attached from upside as well as from downside to the base layers. CZ P 56 029 describes a device in vertical arrangement, in which the fed web is plaited between a pair of conveyor belts by a pair of battens rocking in reciprocating movements against each other. By attachement of adhesive-coated base layer fabrics fed from both sides a configuration resembling a double plush is formed. A kind of modification thereof is a device described in CZ P 87 556, in which the web fed from upside is taken over and deposited on an adhesive-coated fabric by a pair of alternately working battens in the form of a doffer comb. According to CZ AO 235494 the web from the carding machine is formed on the base directly on the doffing point at the outlet drum of the carder. In this method the positions of the formed plaits are not fixed, so that the product can hardly be transferred to the equipment for chemical or mechanical stiffening. All described mechanisms require to attach the perpendicularly shaped webbing to the base fabric by an adhesive immediately when forming individual plaits, otherwise the structure shaped here is unstable and does not permit to apply known methods of mechanical or adhesion stiffening.

A certain progress in this trend was brought in a device according to CZ AO 269 300 and the related Patent Application PV 1819-92. The web fed to the device from upside is formed in plaits by a vibrating fly comb and individual plaits are pressed to a fibrous layer built up between a conveyor belt and a grid by a synchronously vibrating batten.

The driving mechanism of the shaping elements which must exert a highly demanding and accurate motion, is solved according to PV 1819-92 by a four-joint assembly featuring two groups of tie-rods driving the two vibrating elements the fly comb and the batten. The light functional vibrating elements proper are directly connected to assemblies converting a circular motion to a reciprocating motion. A high stress of the assemblies converting the circular motion to a recirpocating motion generates shock forces and causes a vibration of working elements (fly comb, batten). Both shafts are interconnected by sets of three gear-wheels. Though the mechanism provides for a synchronous drive of both working elements, it permits, however, owing to a complicated setup and a considerable mass of the equipment, even in a carefully balanced condition an oscillation frequency merely up to 600 cycles per minute. Such capacity is far from satisfying the needs of modern carding machines, with which the laying device is incorporated into the production line. Said heavy mass of individual components according to this concept leads in a continuous uninterrupted operation to an accelerated wear of the gear-wheels, pins and bearings and consequently to a shorter life expectancy of the machine. With continuing operation time the noise level is gradually increased and the product becomes less uniform. Another consequence thereof is an uneven shaping of individual web plaits with an increasing frequency.

The vibrating elements must be coupled together with the prime mover by a number of joints, the distance from each other depending on the machine frequency required and on the bending rigidity of working elements. Any frequency increase requires therefore an increase in the number of joints and consequently of gear-wheels or of the mass of vibrating elements. Both said possibilities result in an increased overall mass of moving parts of the machine and make any further increase of the working frequency impossible.

NATURE OF THE INVENTION

The limitations mentioned above are remedied by a device for perpendicular stratification of planary fibrous shapes with two synchronously vibrating elements according to the invention. The vibrating elements are connected with the driving member indirectly by the intermediary of one or two robust shafts, rigidly fitted in bearings in a rigid machine framework. The vibrating elements are connected with the shaft(s) directly or by means of a set of flexible joints in sliding fitting The flexible joints can consist of flat steel springs with a width-to-thickness ration higher than 10, but also of tie rods, having sliding fitting and flexible knuckle joints. The flexible joints with sliding fitting permit to convert a circular motion of the driving prime mover and of the massive shaft into a linear reciprocating motion of vibrating elements.

The mechanism can comprise a driving shaft with two crank assemblies fitted with a phase shift between each other. The shafts are driven by the driving mechanism synchronously so that they make a reciprocating motion around their longitudinal axes. Owing to its large diameter and high rigidity, the shaft (possibly a tube) transmitting a reciprocating motion, does not vibrate under the influence of the forces transmitted onto it by the driving mechanism. Thus the shaft transmits to the working element a motion which is evenly distributed along its whole width without generating any unwanted vibration. The merit of the device is in that it prevents any vibration of working elements even at the necessary high operating speed owing to the connection of said elements with rigidly seated shafts by means of a set of resilient joints, own mass of which is substatially smaller as compared with known transmission members. Such device is able to work at a frevency of 2000 cycles per minute. This is a frequency, permitting to process fibrous web with a speed corresponding to the speed of modern carding machines.

Other advantages of the device according to the invention are a high life expectancy at a minimum maintenance demand, a minimum of rotating parts, on which any fibres or web can be wound-on, an easy setting of back position of vibrating elements when adjusting the machine for processing various types of goods directly on the shaft tie-rods, a possibility of easy changing the amplitude of vibrating elements directly on the driving mechanism.

Seting of the phase shift for the vibration motion of the functional members is necessary for a safe web doffing from the doffer comb working edge. This enables an accurate plait shaping, which is a must for obtaining a smooth surface and an even product density.

SURVEY OF FIGURES IN THE DRAWINGS

Figure 2:
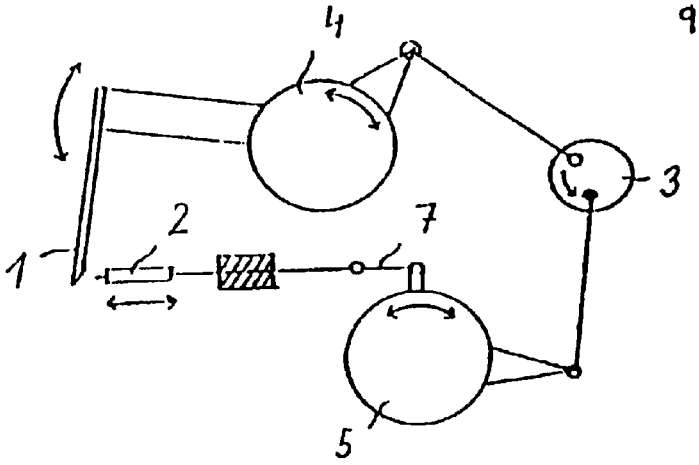
FIG. 2 shows schematically a device for perpendicular stratification of planary fibrous shapes with two shafts and one vibrating element in sliding fitting and a second vibrating element in rigid fitting.
Figure 2A:
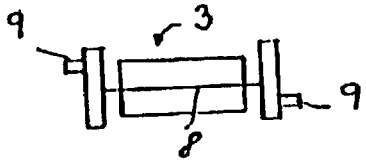

FIG. 2*a* shows schematically a driving mechanism.

Figure 3:
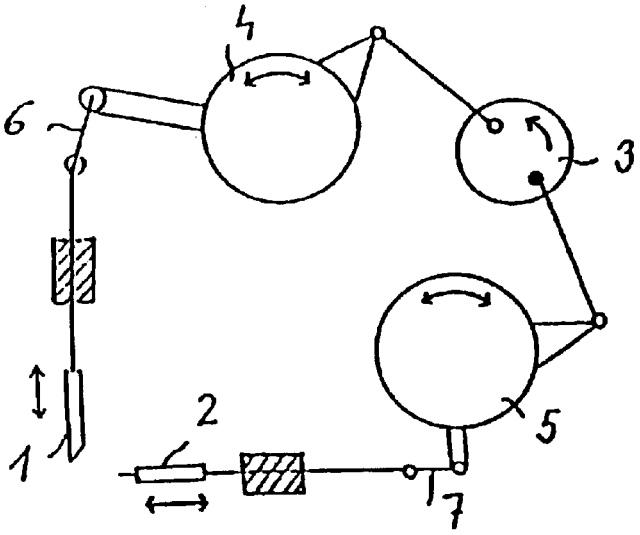

FIG. 3 shows schematically a device for perependicular stratification of planary fibrous shapes with two shafts and vibrating elements in sliding fitting.

EXAMPLES OF EMBODIMENT

Example 1

Figure 1:
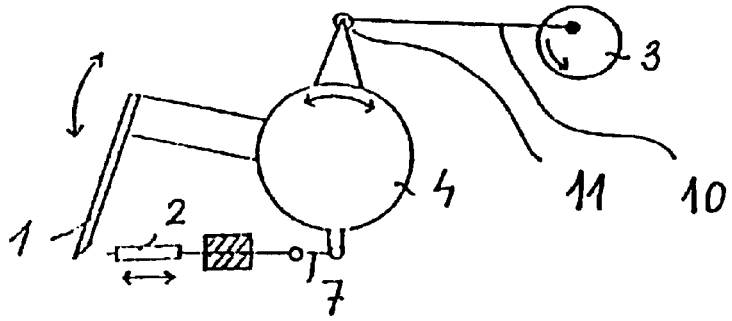
FIG. 1 shows schematically a device for perpendicular stratification of planary fibrous shapes with one single shaft.

A device shown in FIG. 1 serves for processing of a fibrous layer, e.g. fibrous web coming from a carding machine. It consists of two vibrating elements 1 and 2 for perpendicular stratification of web. Said elements 1 and 2 are connected over a shaft 4 and connecting rod 10 with knuckle joint 11 and a driving mechanism 3. The shaft 4 makes a rotating and reciprocating motion along its longitudinal axis. The shaft 4 is a robust tube having an outer diameter 701 mm and is rigidly fitted in bearings in a rigid framework of the machine. The vibrating element 1 is rigidly connected with the shaft 4, the element 2 is joined by means of tie-rods 7 with sliding fitting and flexible knuckle joints.

The vibrating element 2 takes over the fibrous web by means of a set of needles from the element 1 and shapes a plait, which is then pressed to the fibrous layer on the conveyor belt.

The device is suitable for the production of a fibrous layer in which the fibres are oriented predominantly perpendicular towards the fabric plane.

Example 2

A device shown in FIG. 2 consists of two vibrating elements 1 and 2 as in FIG. 1 The element 1 is connected with a driving mechanism 3 over a shaft 4 and the element 2 over a shaft 5 by means of tie-rods 7 with sliding fitting and flexible knuckle joints. The driving mechanism 3 shown in FIG. 2*a* consists of a driving shaft 8 with two crank shafts 9. The crank shafts are set up to allow advanced phase movement of one of vibrating elements.

In comparison with Example 1, due to the advanced phase movement of vibrating element 2, the processed fiber layer is better taken off the vibrating element 1. Therefore the folds are more regular and the fabric of smooth surface is produced.

Example 3

A device in FIG. 3 consists of the same elements as in Example 2, both the vibrating elements 1 and 2 are linked with shafts 4 and 5 by means of tie-rods 6 and 7 with sliding fitting and flexible knuckle joints.

The advantage of the device is the straight-lined movement of both vibrating elements 1 and 2 which does not cause air turbulence and vibrations of the fed in carded web. It leads to improved regularity of final fabric.

Example 4

A device as in Example 3, the flexible knuckle joints 6 and 7 are replaced with steel springs. Due to this the mass of links and dynamic loading of driving mechanism is reduced and the life of device improved.

Utilization of the Device

The device for perpendicular stratification of planary fibrous shapes is utilizable namely in the textile industry.

What we claim is:

1. A device for perpendicular stratification of planary fibrous shapes, especially a fibrous web, with two elements making synchronous and reciprocating motions and connected with a driving mechanism, wherein the elements exerting a reciprocating motion are connected with the driving mechanism indirectly over at least one robust shaft rigidly fitted in bearings in a rigid framework of the device, while one element is coupled to the shaft rigidly or over flexible joints, and a second element is coupled by flexible joints with the same shaft or with another shaft.

2. A device according to claim 1, wherein the driving mechanism consists of one driving shaft with two crank assemblies arranged with a phase shift to each other.

3. A device according to claim 1 wherein the flexible joints consist of flat steel springs with width-to-thickness ratio of more than 10.

4. A device for a perpendicular stratification of planary fibrous shapes, especially a fibrous web, comprising:

first and second elements making synchronous and reciprocating motions;

a driving mechanism comprising a rotating shaft comprising a first crank assembly;

a first reciprocating shaft, said first reciprocating shaft being connected to said rotating shaft through said first crank assembly, said first element being coupled with the driving mechanism through said first reciprocating shaft;

said second element being coupled with the driving mechanism.

5. A device according to claim 4 wherein said first element is rigidly coupled to said first reciprocating shaft.

6. A device according to claim 5 wherein said second element is coupled to said first reciprocating shaft through a first flexible joint.

7. A device according to claim 5, further comprising a second reciprocating shaft, said second element being coupled to said second reciprocating shaft through a first flexible joint, said second reciprocating shaft being connected to said rotating shaft.

8. A device according to claim 7, said rotating shaft further comprising a second crank assembly, said second reciprocating shaft being connected to said rotating shaft through said second crank assembly.

9. A device according to claim 8 wherein said first and second crank assemblies are arranged with a phase shift relative to each other.

10. A device according to claim 9 wherein said first element is coupled to said first reciprocating shaft through a second flexible joint.

11. A device according to claim 9 wherein said first and second flexible joints each comprises at least one flat steel spring having a width-to-thickness ratio of more than 10.

12. A device according to claim 7 wherein said first element is coupled to said first reciprocating shaft through a second flexible joint.

* * * * *